US011505898B2

(12) United States Patent
Köckritz et al.

(10) Patent No.: US 11,505,898 B2
(45) Date of Patent: Nov. 22, 2022

(54) LAMINATED PAPER MACHINE CLOTHING

(71) Applicant: VOITH PATENT GMBH, Heidenheim (DE)

(72) Inventors: Uwe Köckritz, Heidenheim (DE); Jens Kallenberg, Herbrechtingen (DE); Petra Hack-Ueberall, Langenau-Horvelsingen (DE); Gregory Allen Elliott, Cincinnati, OH (US); Thomas Anthony Hensler, Cincinnati, OH (US); James E. Sealy, II, Belton, SC (US); Marc Paul Begin, Simpsonville, SC (US)

(73) Assignee: FIRST QUALITY TISSUE SE, LLC, Anderson, SC (US)

( * ) Notice: Subject to any disclaimer, the term of this patent is extended or adjusted under 35 U.S.C. 154(b) by 0 days.

(21) Appl. No.: 17/250,224

(22) PCT Filed: Jun. 18, 2019

(86) PCT No.: PCT/EP2019/065940
§ 371 (c)(1),
(2) Date: Dec. 18, 2020

(87) PCT Pub. No.: WO2019/243287
PCT Pub. Date: Dec. 26, 2019

(65) Prior Publication Data

US 2021/0269975 A1 Sep. 2, 2021

(30) Foreign Application Priority Data

Jun. 20, 2018 (DE) ..... 10 2018 114 748.1

(51) Int. Cl.
*D21F 1/00* (2006.01)

(52) U.S. Cl.
CPC ..... *D21F 1/0045* (2013.01)

(58) Field of Classification Search
CPC ..... D21F 1/0045; D21F 11/06; D21F 1/0036; D21F 1/00
See application file for complete search history.

(56) References Cited

U.S. PATENT DOCUMENTS 2,919,467 A 1/1960 Mercer
2,926,154 A 2/1960 Keim
(Continued)

FOREIGN PATENT DOCUMENTS

CA 2168894 A1 8/1997
CA 2795139 A1 10/2011
(Continued)

OTHER PUBLICATIONS

PCT International Search Report dated Sep. 20, 2019 in connection with PCT/EP2019/065940.
(Continued)

*Primary Examiner* — Eric Hug
*Assistant Examiner* — Matthew M Eslami
(74) *Attorney, Agent, or Firm* — Amster, Rothstein & Ebenstein LLP

(57) ABSTRACT

The invention relates to a clothing (10) for a machine to manufacture or refine a fibrous web, in particular a paper, cardboard, or tissue web, comprising a substrate (40) and a grid structure (20) applied on the substrate (40), on which the fibrous web is transported when the clothing (10) is used as intended, wherein the grid structure (20') comprises a plurality of first elements (24'), all of which aligned in a first direction, and a plurality of second elements (26'), all of which aligned in a second direction, which is different from the first direction, wherein the first elements (24') penetrate the second elements (26'), forming the grid structure (20'), such that an underside of the first elements (24') facing the substrate (40) and an underside of the second elements (26')
(Continued)

Figure 1:
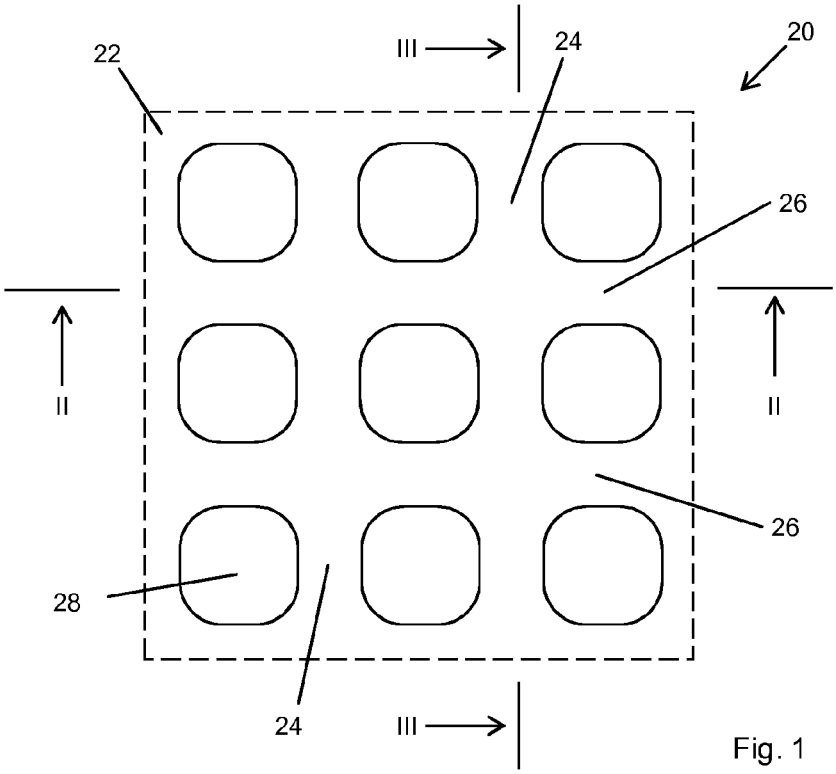

facing the substrate (40) are located in a common plane. In addition, the present invention relates to a method for producing such a clothing.

15 Claims, 2 Drawing Sheets

(56) References Cited

U.S. PATENT DOCUMENTS

| | | | |
|---|---|---|---|
| 3,049,469 | A | 8/1962 | Davison |
| 3,058,873 | A | 10/1962 | Keim et al. |
| 3,097,994 | A | 7/1963 | Dickens et al. |
| 3,125,552 | A | 3/1964 | Loshaek et al. |
| 3,143,150 | A | 8/1964 | Buchanan |
| 3,186,900 | A | 6/1965 | De Young |
| 3,197,427 | A | 7/1965 | Schmalz |
| 3,224,986 | A | 12/1965 | Butler et al. |
| 3,224,990 | A | 12/1965 | Babcock |
| 3,227,615 | A | 1/1966 | Korden |
| 3,227,671 | A | 1/1966 | Keim |
| 3,239,491 | A | 3/1966 | Tsou et al. |
| 3,240,664 | A | 3/1966 | Earle, Jr. |
| 3,240,761 | A | 3/1966 | Keim et al. |
| 3,248,280 | A | 4/1966 | Hyland, Jr. |
| 3,250,664 | A | 5/1966 | Conte et al. |
| 3,252,181 | A | 5/1966 | Hureau |
| 3,301,746 | A | 1/1967 | Sanford et al. |
| 3,311,594 | A | 3/1967 | Earle, Jr. |
| 3,329,657 | A | 7/1967 | Strazdins et al. |
| 3,332,834 | A | 7/1967 | Reynolds, Jr. |
| 3,332,901 | A | 7/1967 | Keim |
| 3,352,833 | A | 11/1967 | Earle, Jr. |
| 3,384,692 | A | 5/1968 | Galt et al. |
| 3,414,459 | A | 12/1968 | Wells |
| 3,442,754 | A | 5/1969 | Espy |
| 3,459,697 | A | 8/1969 | Goldberg et al. |
| 3,473,576 | A | 10/1969 | Amneus |
| 3,483,077 | A | 12/1969 | Aldrich |
| 3,545,165 | A | 12/1970 | Greenwell |
| 3,556,932 | A | 1/1971 | Coscia et al. |
| 3,573,164 | A | 3/1971 | Friedberg et al. |
| 3,609,126 | A | 9/1971 | Asao et al. |
| 3,666,609 | A | 5/1972 | Kalwaites et al. |
| 3,672,949 | A | 6/1972 | Brown |
| 3,672,950 | A | 6/1972 | Murphy et al. |
| 3,773,290 | A | 11/1973 | Mowery |
| 3,778,339 | A | 12/1973 | Williams et al. |
| 3,813,362 | A | 5/1974 | Coscia et al. |
| 3,855,158 | A | 12/1974 | Petrovich et al. |
| 3,877,510 | A | 4/1975 | Tegtmeier et al. |
| 3,905,863 | A | 9/1975 | Ayers |
| 3,911,173 | A | 10/1975 | Sprague, Jr. |
| 3,974,025 | A | 8/1976 | Ayers |
| 3,994,771 | A | 11/1976 | Morgan, Jr. et al. |
| 3,998,690 | A | 12/1976 | Lyness et al. |
| 4,038,008 | A | 7/1977 | Larsen |
| 4,075,382 | A | 2/1978 | Chapman et al. |
| 4,088,528 | A | 5/1978 | Berger et al. |
| 4,098,632 | A | 7/1978 | Sprague, Jr. |
| 4,102,737 | A | 7/1978 | Morton |
| 4,129,528 | A | 12/1978 | Petrovich et al. |
| 4,147,586 | A | 4/1979 | Petrovich et al. |
| 4,184,519 | A | 1/1980 | McDonald et al. |
| 4,187,618 | A | 2/1980 | Diehl |
| 4,190,692 | A | 2/1980 | Larsen |
| 4,191,609 | A | 3/1980 | Trokhan |
| 4,252,761 | A | 2/1981 | Schoggen et al. |
| 3,026,231 | A | 3/1982 | Chavannes |
| 4,320,162 | A | 3/1982 | Schulz |
| 4,331,510 | A | 5/1982 | Wells |
| 3,066,066 | A | 11/1982 | Keim et al. |
| 4,382,987 | A | 5/1983 | Smart |
| 4,440,597 | A | 4/1984 | Wells et al. |
| 4,501,862 | A | 2/1985 | Keim |
| 4,507,351 | A | 3/1985 | Johnson et al. |
| 4,514,345 | A | 4/1985 | Johnson et al. |
| 4,515,657 | A | 5/1985 | Maslanka |
| 4,528,239 | A | 7/1985 | Trokhan |
| 4,529,480 | A | 7/1985 | Trokhan |
| 4,537,657 | A | 8/1985 | Keim |
| 4,545,857 | A | 10/1985 | Wells |
| 4,637,859 | A | 1/1987 | Trokhan |
| 4,678,590 | A | 7/1987 | Nakamura et al. |
| 4,714,736 | A | 12/1987 | Juhl et al. |
| 4,770,920 | A | 9/1988 | Larsonneur |
| 4,780,357 | A | 10/1988 | Akao |
| 4,808,467 | A | 2/1989 | Suskind et al. |
| 4,836,894 | A | 6/1989 | Chance et al. |
| 4,849,054 | A | 7/1989 | Klowak |
| 4,885,202 | A | 12/1989 | Lloyd et al. |
| 4,891,249 | A | 1/1990 | McIntyre |
| 4,909,284 | A | 3/1990 | Kositake |
| 4,949,668 | A | 8/1990 | Heindel et al. |
| 4,949,688 | A | 8/1990 | Bayless |
| 4,983,256 | A | 1/1991 | Combette et al. |
| 4,984,728 | A | 1/1991 | Brinkmeier et al. |
| 4,996,091 | A | 2/1991 | McIntyre |
| 5,059,282 | A | 10/1991 | Ampulski et al. |
| 5,128,091 | A | 7/1992 | Agur et al. |
| 5,143,776 | A | 9/1992 | Givens |
| 5,149,401 | A | 9/1992 | Langevin et al. |
| 5,152,874 | A | 10/1992 | Keller |
| 5,211,813 | A | 5/1993 | Sawley et al. |
| 5,238,537 | A | 8/1993 | Dutt |
| 5,239,047 | A | 8/1993 | Devore et al. |
| 5,279,098 | A | 1/1994 | Fukuda |
| 5,281,306 | A | 1/1994 | Kakiuchi et al. |
| 5,334,289 | A | 8/1994 | Trokhan et al. |
| 5,347,795 | A | 9/1994 | Fukuda |
| 5,397,435 | A | 3/1995 | Ostendorf et al. |
| 5,399,412 | A | 3/1995 | Sudall et al. |
| 5,405,501 | A | 4/1995 | Phan et al. |
| 5,409,572 | A | 4/1995 | Kershaw et al. |
| 5,429,686 | A | 7/1995 | Chiu et al. |
| 5,439,559 | A | 8/1995 | Crouse |
| 5,447,012 | A | 9/1995 | Kovacs et al. |
| 5,470,436 | A | 11/1995 | Wagle et al. |
| 5,487,313 | A | 1/1996 | Johnson |
| 5,509,913 | A | 4/1996 | Yeo |
| 5,510,002 | A | 4/1996 | Hermans et al. |
| 5,529,665 | A | 6/1996 | Kaun |
| 5,581,906 | A | 12/1996 | Ensign et al. |
| 5,591,147 | A | 1/1997 | Couture-Dorschner et al. |
| 5,607,551 | A | 3/1997 | Farrington, Jr. et al. |
| 5,611,890 | A | 3/1997 | Vinson et al. |
| 5,628,876 | A | 5/1997 | Ayers et al. |
| 5,635,028 | A | 6/1997 | Vinson et al. |
| 5,649,916 | A | 7/1997 | Dipalma et al. |
| 5,671,897 | A | 9/1997 | Ogg et al. |
| 5,672,248 | A | 9/1997 | Wendt et al. |
| 5,679,222 | A | 10/1997 | Rasch et al. |
| 5,685,428 | A | 11/1997 | Herbers et al. |
| 5,728,268 | A | 3/1998 | Weisman et al. |
| 5,746,887 | A | 5/1998 | Wendt et al. |
| 5,753,067 | A | 5/1998 | Fukuda et al. |
| 5,762,761 | A | 6/1998 | Kivimaa |
| 5,772,845 | A | 6/1998 | Farrington, Jr. et al. |
| 5,806,569 | A | 9/1998 | Gulya et al. |
| 5,827,384 | A | 10/1998 | Canfield et al. |
| 5,832,962 | A | 11/1998 | Kaufman et al. |
| 5,846,380 | A | 12/1998 | Van Phan et al. |
| 5,855,738 | A | 1/1999 | Weisman et al. |
| 5,858,554 | A | 1/1999 | Neal et al. |
| 5,865,396 | A | 2/1999 | Ogg et al. |
| 5,865,950 | A | 2/1999 | Vinson et al. |
| 5,893,965 | A | 4/1999 | Trokhan et al. |
| 5,904,811 | A | 5/1999 | Ampulski et al. |
| 5,913,765 | A | 6/1999 | Burgess et al. |
| 5,942,085 | A | 8/1999 | Neal et al. |
| 5,944,954 | A | 8/1999 | Vinson et al. |
| 5,948,210 | A | 9/1999 | Huston |
| 5,980,691 | A | 11/1999 | Weisman et al. |
| 5,998,024 | A | 12/1999 | Burazin |
| 6,036,139 | A | 3/2000 | Ogo |

(56) References Cited

U.S. PATENT DOCUMENTS 6,039,838 A 3/2000 Kaufman et al.
6,048,938 A 4/2000 Neal et al.
6,060,149 A 5/2000 Nissing et al.
6,106,670 A 8/2000 Weisman et al.
6,149,769 A 11/2000 Mohammadi et al.
6,162,327 A 12/2000 Batra et al.
6,162,329 A 12/2000 Vinson et al.
6,187,138 B1 2/2001 Neal et al.
6,200,419 B1 3/2001 Phan
6,203,867 B1 3/2001 Huhtelin
6,207,734 B1 3/2001 Vinson et al.
6,231,723 B1 5/2001 Kanitz et al.
6,287,426 B1 9/2001 Edwards et al.
6,303,233 B1 10/2001 Amon et al.
6,319,362 B1 11/2001 Huhtelin et al.
6,344,111 B1 2/2002 Wilhelm
6,419,795 B1 7/2002 Dutt
6,420,013 B1 7/2002 Vinson et al.
6,420,100 B1 7/2002 Trokhan et al.
6,423,184 B2 7/2002 Vahatalo et al.
6,432,273 B1 8/2002 Honkalampi
6,458,246 B1 10/2002 Kanitz et al.
6,464,831 B1 10/2002 Trokhan et al.
6,473,670 B1 10/2002 Huhtelin
6,521,089 B1 2/2003 Griech et al.
6,537,407 B1 3/2003 Law et al.
6,547,928 B2 4/2003 Bamholtz et al.
6,551,453 B2 4/2003 Weisman et al.
6,551,691 B1 4/2003 Weisman et al.
6,572,722 B1 6/2003 Pratt
6,579,418 B2 6/2003 Vinson et al.
6,602,454 B2 8/2003 McGuire et al.
6,607,637 B1 8/2003 Vinson et al.
6,610,173 B1 8/2003 Lindsay et al.
6,613,194 B2 9/2003 Kanitz et al.
6,660,362 B1 12/2003 Lindsay et al.
6,673,202 B2 1/2004 Burazin
6,701,637 B2 3/2004 Lindsay et al.
6,755,939 B2 6/2004 Vinson et al.
6,773,647 B2 8/2004 McGuire et al.
6,797,117 B1 9/2004 McKay et al.
6,808,599 B2 10/2004 Burazin
6,821,386 B2 11/2004 Weisman et al.
6,821,391 B2 11/2004 Scherb et al.
6,827,818 B2 12/2004 Farrington, Jr. et al.
6,849,159 B1 2/2005 Ilvespaa
6,863,777 B2 3/2005 Kanitz et al.
6,896,767 B2 5/2005 Wilhelm
6,939,443 B2 9/2005 Ryan et al.
6,986,830 B2 1/2006 Scherb et al.
6,998,017 B2 2/2006 Lindsay et al.
7,005,043 B2 2/2006 Toney et al.
7,014,735 B2 3/2006 Kramer
7,032,625 B2 4/2006 Rydin
7,105,465 B2 9/2006 Patel et al.
7,155,876 B2 1/2007 VanderTuin et al.
7,157,389 B2 1/2007 Branham et al.
7,169,265 B1 1/2007 Kramer et al.
7,182,837 B2 2/2007 Chen et al.
7,194,788 B2 3/2007 Clark et al.
7,235,156 B2 6/2007 Baggot
7,236,166 B2 6/2007 Zinniel et al.
7,269,929 B2 9/2007 VanderTuin et al.
7,294,230 B2 11/2007 Flugge-Berendes et al.
7,311,853 B2 12/2007 Vinson et al.
7,328,550 B2 2/2008 Floding et al.
7,339,378 B2 3/2008 Han et al.
7,351,307 B2 4/2008 Scherb et al.
7,357,847 B2 4/2008 Weigant
7,381,665 B2 6/2008 Onikubo
7,387,706 B2 6/2008 Herman et al.
7,399,378 B2 7/2008 Fdwards et al.
7,419,569 B2 9/2008 Hermans
7,427,434 B2 9/2008 Busam
7,431,801 B2 10/2008 Conn et al.
7,432,309 B2 10/2008 Vinson
7,442,278 B2 10/2008 Murray et al.
7,452,447 B2 11/2008 Duan et al.
7,476,293 B2 1/2009 Herman et al.
7,493,923 B2 2/2009 Barrett et al.
7,494,563 B2 2/2009 Edwards et al.
7,510,631 B2 3/2009 Scherb
7,510,831 B2 3/2009 Scherb et al.
7,513,975 B2 4/2009 Burma
7,563,344 B2 7/2009 Beuther
7,582,187 B2 9/2009 Scherb et al.
7,611,607 B2 11/2009 Mullally et al.
7,622,020 B2 11/2009 Awofeso
7,662,462 B2 2/2010 Noda
7,670,678 B2 3/2010 Phan
7,683,126 B2 3/2010 Neal et al.
7,686,923 B2 3/2010 Scherb et al.
7,687,140 B2 3/2010 Manifold et al.
7,691,230 B2 4/2010 Scherb et al.
7,744,722 B1 6/2010 Tucker et al.
7,744,726 B2 6/2010 Scherb et al.
7,799,382 B2 9/2010 Payne et al.
7,811,418 B2 10/2010 Klerelid et al.
7,815,978 B2 10/2010 Davenport et al.
7,823,366 B2 11/2010 Schoeneck
7,842,163 B2 11/2010 Nickel et al.
7,867,361 B2 1/2011 Salaam et al.
7,871,692 B2 1/2011 Morin et al.
7,887,673 B2 2/2011 Andersson et al.
7,905,989 B2 3/2011 Scherb et al.
7,914,866 B2 3/2011 Shannon et al.
7,931,781 B2 4/2011 Scherb et al.
7,951,269 B2 5/2011 Herman et al.
7,955,549 B2 6/2011 Noda
7,959,764 B2 6/2011 Ringer et al.
7,972,475 B2 7/2011 Chan et al.
7,989,058 B2 8/2011 Manifold et al.
8,034,463 B2 10/2011 Leimbach et al.
8,051,629 B2 11/2011 Pazdernik et al.
8,075,739 B2 12/2011 Scherb et al.
8,092,652 B2 1/2012 Scherb et al.
8,118,979 B2 2/2012 Herman et al.
8,147,649 B1 4/2012 Tucker et al.
8,152,959 B2 4/2012 Elony et al.
8,196,314 B2 6/2012 Munch
8,216,427 B2 7/2012 Klerelid et al.
8,236,135 B2 8/2012 Prodoehl et al.
8,303,773 B2 11/2012 Scherb et al.
8,382,956 B2 2/2013 Boechat et al.
8,402,673 B2 3/2013 Da Silva et al.
8,409,404 B2 4/2013 Harper et al.
8,435,384 B2 5/2013 Da Silva et al.
8,440,055 B2 5/2013 Schers et al.
8,445,032 B2 5/2013 Topolkaraev et al.
8,454,800 B2 6/2013 Mourad et al.
8,470,133 B2 6/2013 Cunnane et al.
8,506,756 B2 8/2013 Denis et al.
8,544,184 B2 10/2013 Da Silva et al.
8,574,211 B2 11/2013 Morita
8,580,083 B2 11/2013 Boechat et al.
8,728,277 B2 5/2014 Boechat et al.
8,758,569 B2 6/2014 Aberg et al.
8,771,466 B2 7/2014 Denis et al.
8,801,903 B2 8/2014 Mourad et al.
8,815,057 B2 8/2014 Eberhardt et al.
8,822,009 B2 9/2014 Riviere et al.
8,968,517 B2 3/2015 Ramaratnam et al.
8,980,062 B2 3/2015 Karlsson et al.
9,005,710 B2 4/2015 Jones et al.
D734,617 S 7/2015 Seitzinger et al.
9,095,477 B2 8/2015 Yamaguchi
D738,633 S 9/2015 Seitzinger et al.
9,315,940 B2 4/2016 Lee
9,352,530 B2 5/2016 Hansen
9,382,666 B2 7/2016 Ramaratnam et al.
9,506,203 B2 11/2016 Ramaralnam et al.
9,580,872 B2 2/2017 Ramaratnam et al.
9,617,077 B2 4/2017 Shoji et al.
9,702,089 B2 7/2017 Ramaratnam et al.

(56) References Cited

U.S. PATENT DOCUMENTS 9,702,090 B2 7/2017 Ramaratnam et al.
9,719,213 B2 8/2017 Miller, IV et al.
9,725,853 B2 8/2017 Ramaratnam et al.
9,840,812 B2 12/2017 Sealey, II
10,099,425 B2 10/2018 Miller, IV et al.
10,208,426 B2 2/2019 Sealey et al.
10,415,185 B2 9/2019 Sealey et al.
10,619,309 B2 4/2020 Sealey, II
10,675,810 B2 6/2020 Sealey, II et al.
10,787,767 B2 9/2020 Sealey et al.
10,815,620 B2 10/2020 Sealey et al.
2001/0018068 A1 8/2001 Lorenzi et al.
2002/0028230 A1 3/2002 Eichhorn et al.
2002/0060049 A1 5/2002 Kanitz et al.
2002/0061386 A1 5/2002 Carson et al.
2002/0062936 A1 5/2002 Klerelid
2002/0098317 A1 7/2002 Jaschinski et al.
2002/0110655 A1 8/2002 Seth
2002/0115194 A1 8/2002 Lange et al.
2002/0125606 A1 9/2002 McGuire et al.
2003/0024674 A1 2/2003 Kanitz et al.
2003/0056911 A1 3/2003 Hermans et al.
2003/0056917 A1 3/2003 Jimenez
2003/0070781 A1 4/2003 Hermans et al.
2003/0114071 A1 6/2003 Everhart
2003/0123915 A1 7/2003 Klinefelter et al.
2003/0159401 A1 8/2003 Sorensson et al.
2003/0188843 A1 10/2003 Kanitz et al.
2003/0218274 A1 11/2003 Boutilier et al.
2004/0051211 A1 3/2004 Mastro et al.
2004/0118531 A1 6/2004 Shannon et al.
2004/0123963 A1 7/2004 Chen et al.
2004/0126601 A1 7/2004 Kramer et al.
2004/0126710 A1 7/2004 Hill et al.
2004/0127122 A1 7/2004 Davenport et al.
2004/0168784 A1 9/2004 Duan
2004/0173333 A1 9/2004 Hermans
2004/0234804 A1 11/2004 Liu et al.
2005/0016704 A1 1/2005 Huhtelin
2005/0069679 A1 3/2005 Stelljes et al.
2005/0069680 A1 3/2005 Stelljes et al.
2005/0098281 A1 5/2005 Schulz et al.
2005/0112115 A1 5/2005 Khan
2005/0123726 A1 6/2005 Broering et al.
2005/0130536 A1 6/2005 Siebers et al.
2005/0136222 A1 6/2005 Hada et al.
2005/0148257 A1 7/2005 Hermans et al.
2005/0150626 A1 7/2005 Kanitz et al.
2005/0166551 A1 8/2005 Keane et al.
2005/0167061 A1 8/2005 Scherb
2005/0167062 A1* 8/2005 Herman ..... D21F 1/0036 162/358.3
2005/0241786 A1 11/2005 Edwards et al.
2005/0241788 A1 11/2005 Baggot et al.
2005/0252626 A1 11/2005 Chen et al.
2005/0280184 A1 12/2005 Sayers et al.
2005/0287340 A1 12/2005 Morelli et al.
2006/0005916 A1 1/2006 Stelljes et al.
2006/0013998 A1 1/2006 Stelljes et al.
2006/0019567 A1 1/2006 Sayers
2006/0083899 A1 4/2006 Burazin et al.
2006/0085998 A1 4/2006 Herman
2006/0093788 A1 5/2006 Behm et al.
2006/0113049 A1 6/2006 Knobloch et al.
2006/0130986 A1 6/2006 Flugge-Berendes et al.
2006/0194022 A1 8/2006 Boutilier et al.
2006/0248723 A1 11/2006 Gustafson
2006/0269706 A1 11/2006 Shannon et al.
2007/0020315 A1 1/2007 Shannon et al.
2007/0131366 A1 6/2007 Underhill et al.
2007/0137813 A1 6/2007 Nickel et al.
2007/0137814 A1 6/2007 Gao
2007/0170610 A1 7/2007 Payne et al.
2007/0240842 A1 10/2007 Scherb et al.
2007/0251659 A1 11/2007 Fernandes et al.
2007/0251660 A1 11/2007 Walkenhaus et al.
2007/0256806 A1 11/2007 Scherb
2007/0267157 A1 11/2007 Kanitz et al.
2007/0272381 A1 11/2007 Elony et al.
2007/0275866 A1 11/2007 Dykstra
2007/0298221 A1 12/2007 Vinson
2008/0023169 A1 1/2008 Fernandes
2008/0035289 A1 2/2008 Edwards et al.
2008/0076695 A1 3/2008 Uitenbroek et al.
2008/0149292 A1 6/2008 Scherb
2008/0156450 A1 7/2008 Klerelid et al.
2008/0199655 A1 8/2008 Monnerie et al.
2008/0210397 A1 9/2008 Scherb
2008/0245498 A1 10/2008 Ostendorf et al.
2008/0302493 A1 12/2008 Boatman et al.
2008/0308247 A1 12/2008 Ringer et al.
2009/0020248 A1 1/2009 Sumnicht et al.
2009/0056892 A1 3/2009 Rekoske
2009/0061709 A1 3/2009 Nakai et al.
2009/0068909 A1 3/2009 Quigley
2009/0205797 A1 8/2009 Fernandes et al.
2009/0218056 A1 9/2009 Manifold et al.
2010/0065234 A1 3/2010 Klerelid et al.
2010/0119779 A1 5/2010 Ostendorf et al.
2010/0129597 A1 5/2010 Hansen et al.
2010/0224338 A1 9/2010 Harper et al.
2010/0230064 A1 9/2010 Eagles et al.
2010/0236034 A1 9/2010 Eagles et al.
2010/0239825 A1 9/2010 Sheehan et al.
2010/0272965 A1 10/2010 Schinkoreit et al.
2010/0300635 A1 12/2010 Mausser
2011/0027545 A1 2/2011 Harlacher et al.
2011/0180223 A1 7/2011 Klerelid et al.
2011/0189435 A1 8/2011 Manifold et al.
2011/0189442 A1 8/2011 Manifold et al.
2011/0206913 A1 8/2011 Manifold et al.
2011/0223381 A1 9/2011 Sauter et al.
2011/0253329 A1 10/2011 Manifold et al.
2011/0265967 A1 11/2011 Van Phan
2011/0303379 A1 12/2011 Boechat et al.
2012/0024489 A1 2/2012 Quigley
2012/0027997 A1 2/2012 Aberg
2012/0144611 A1 6/2012 Baker et al.
2012/0152475 A1 6/2012 Edwards et al.
2012/0177888 A1 7/2012 Escafere et al.
2012/0193058 A1 8/2012 Wokurek
2012/0244241 A1 9/2012 McNeil
2012/0267063 A1 10/2012 Klerelid et al.
2012/0297560 A1 11/2012 Zwick et al.
2013/0008135 A1 1/2013 Moore
2013/0029105 A1 1/2013 Miller et al.
2013/0029106 A1 1/2013 Lee et al.
2013/0133851 A1 5/2013 Boechat et al.
2013/0150817 A1 6/2013 Kainth et al.
2013/0160960 A1 6/2013 Hermans et al.
2013/0206348 A1 8/2013 Quigley
2013/0209749 A1 8/2013 Myangiro et al.
2013/0220566 A1 8/2013 Straub et al.
2013/0248129 A1 9/2013 Manifold et al.
2013/0327487 A1 12/2013 Espinosa et al.
2014/0004307 A1 1/2014 Sheehan
2014/0041820 A1 2/2014 Ramaratnam et al.
2014/0041822 A1 2/2014 Boechat et al.
2014/0050890 A1 2/2014 Zwick et al.
2014/0053994 A1 2/2014 Manifold et al.
2014/0098924 A1 4/2014 Rekokske et al.
2014/0182798 A1 7/2014 Polat et al.
2014/0242320 A1 8/2014 McNeil et al.
2014/0272269 A1 9/2014 Hansen
2014/0272747 A1 9/2014 Ciurkot
2014/0284237 A1 9/2014 Gosset
2014/0360519 A1 12/2014 George et al.
2015/0059995 A1 3/2015 Ramaratnam et al.
2015/0102526 A1 4/2015 Ward et al.
2015/0129145 A1 5/2015 Chou et al.
2015/0211179 A1 7/2015 Alias et al.
2015/0241788 A1 8/2015 Yamaguchi
2015/0330029 A1 11/2015 Ramaratnam et al.
2016/0060811 A1 3/2016 Riding et al.

(56) References Cited

U.S. PATENT DOCUMENTS

| | | | |
|---|---|---|---|
| 2016/0069022 | A1 | 3/2016 | Lee |
| 2016/0076200 | A1 | 3/2016 | Gustafson |
| 2016/0090692 | A1 | 3/2016 | Eagles et al. |
| 2016/0090693 | A1 | 3/2016 | Eagles et al. |
| 2016/0130762 | A1 | 5/2016 | Ramaralnam et al. |
| 2016/0145810 | A1 | 5/2016 | Miller, IV et al. |
| 2016/0159007 | A1 | 6/2016 | Milter, IV et al. |
| 2016/0160448 | A1 | 6/2016 | Miller, IV et al. |
| 2016/0185041 | A1 | 6/2016 | Topolkaraev et al. |
| 2016/0185050 | A1 | 6/2016 | Topolkaraev et al. |
| 2016/0273168 | A1 | 9/2016 | Ramaratnam et al. |
| 2016/0273169 | A1 | 9/2016 | Ramaratnam et al. |
| 2016/0289897 | A1 | 10/2016 | Ramaratnam et al. |
| 2016/0289898 | A1 | 10/2016 | Ramaratnam et al. |
| 2017/0002515 | A1 | 1/2017 | Saikkonen |
| 2017/0044717 | A1 | 2/2017 | Quigley |
| 2017/0101741 | A1 | 4/2017 | Sealey et al. |
| 2017/0167082 | A1 | 6/2017 | Ramaratnam et al. |
| 2017/0183819 | A1* | 6/2017 | Abraham ..... D21F 1/0027 |
| 2017/0226698 | A1 | 8/2017 | LeBrun et al. |
| 2017/0233946 | A1 | 8/2017 | Sealey et al. |
| 2017/0253422 | A1 | 9/2017 | Anklam et al. |
| 2017/0268178 | A1 | 9/2017 | Ramaratnam et al. |
| 2017/0292224 | A1 | 10/2017 | Miller, IV |
| 2017/0314207 | A1 | 11/2017 | Sealey, II |
| 2018/0058011 | A1 | 3/2018 | Sealey, II |
| 2018/0066399 | A1 | 3/2018 | Sealey et al. |
| 2018/0073195 | A1 | 3/2018 | Sealey, II |
| 2018/0119347 | A1* | 5/2018 | Brent, Jr. ..... D21F 5/181 |
| 2019/0063001 | A1 | 2/2019 | Sealey, II |
| 2019/0112761 | A1 | 4/2019 | Sealey, II |
| 2019/0112762 | A1 | 4/2019 | Sealey et al. |
| 2019/0360153 | A1 | 11/2019 | Sealey, II |
| 2020/0009812 | A1 | 1/2020 | Miller, IV et al. |
| 2020/0262134 | A1 | 8/2020 | Sealey, II et al. |

FOREIGN PATENT DOCUMENTS

| | | | |
|---|---|---|---|
| CA | 3014325 | A1 | 8/2017 |
| CN | 1138356 | A | 12/1996 |
| CN | 1207149 | A | 2/1999 |
| CN | 1244899 | A | 2/2000 |
| CN | 1268559 | A | 10/2000 |
| CN | 1377405 | A | 10/2002 |
| CN | 2728254 | Y | 9/2005 |
| DE | 4242539 | A1 | 8/1993 |
| DE | 102014213444 | A1 | 1/2016 |
| EP | 0097036 | A2 | 12/1983 |
| EP | 0979895 | A1 | 2/2000 |
| EP | 1911574 | A1 | 1/2007 |
| EP | 1339915 | B1 | 7/2007 |
| EP | 2000587 | A1 | 12/2008 |
| EP | 2123826 | A2 | 5/2009 |
| GB | 946093 | A | 1/1964 |
| JP | 2013208298 | A | 10/2013 |
| JP | 2014213138 | A | 11/2014 |
| JP | 2015092034 | A | 5/2015 |
| WO | 96/06223 | A1 | 2/1996 |
| WO | 00/75423 | A1 | 12/2000 |
| WO | 01/57312 | A1 | 8/2001 |
| WO | 200382550 | A2 | 10/2003 |
| WO | 200445834 | A1 | 6/2004 |
| WO | 2005075732 | A2 | 8/2005 |
| WO | 2007070145 | A1 | 6/2007 |
| WO | 2007125090 | A1 | 11/2007 |
| WO | 2008019702 | A1 | 2/2008 |
| WO | 2009006709 | A1 | 1/2009 |
| WO | 2009/061079 | A1 | 5/2009 |
| WO | 2011028823 | A1 | 3/2011 |
| WO | 2012063360 | A2 | 1/2012 |
| WO | 2013024297 | A1 | 2/2013 |
| WO | 2013136471 | A1 | 9/2013 |
| WO | 2014/022848 | A1 | 2/2014 |
| WO | 201500755 | A1 | 1/2015 |
| WO | 2015/176063 | A1 | 11/2015 |
| WO | 2016/077594 | A1 | 5/2016 |
| WO | 2016/090242 | A1 | 6/2016 |
| WO | 2016/090364 | A1 | 6/2016 |
| WO | 2016085704 | A1 | 6/2016 |
| WO | 2016/086019 | A1 | 8/2016 |
| WO | 2017066465 | A1 | 4/2017 |
| WO | 2017066656 | A1 | 4/2017 |
| WO | 2017139786 | A1 | 8/2017 |
| WO | 20192224348 | A1 | 11/2019 |

OTHER PUBLICATIONS

U.S. Appl. No. 62/294,158, filed Feb. 11, 2016.
U.S. Appl. No. 17/171,182, filed Feb. 9, 2021.
U.S. Appl. No. 62/671,696, filed May 15, 2018.
U.S. Appl. No. 62/088.095, filed Dec. 5, 2014.
U.S. Appl. No. 62/240,924, filed Oct. 13, 2015,.
"Press Fabrics," Valmet pp. 1-18 (Year 2014).
Modulus of Elasticity or Young's Modulus—and Tensile Modulus for common Materials, pp. 103, No Date, The Engineering Toolbox, [online], retrieved from the internet, {retrieved Oct. 10, 2017], <URL:http://www.engineeringtoolbox.com/young-modulus-d_417.html>.

* cited by examiner

LAMINATED PAPER MACHINE CLOTHING

The invention relates to a clothing for a machine for producing or refining a fibrous web, in particular a paper, cardboard, or tissue web, comprising a substrate and a grid structure applied on said substrate, on which the fibrous web is transported when used as intended, with the grid structure comprising a plurality of first elements, all of which being aligned in a first direction, and a plurality of second elements, all of which being aligned in a second direction, which differs from the first direction.

Such a clothing is known from WO 2017/139786 A1. In the clothing described in WO 2017/139786 A1, the substrate formed from a web and the applied grid structure are connected to each other in such a way that air channels are formed in the plane between the substrate and grid structure.

It is disadvantageous in the clothing known from the prior art that the connection of the grid structure on the substrate is not optimal, or here a correspondingly stable connection must be achieved using extensive bonding procedures.

The object of the present invention is to provide a clothing which allows to generate a reliable connection between the substrate and the grid structure in a simple way.

The objective is attained according to the invention by an embodiment as described in claim 1, as well as by means of a manufacturing method for such a clothing according to claim 10. Other advantageous features of the embodiment according to the invention are discernible from the dependent claims. According to the invention, the generic clothing described at the outset is characterized in that the first elements penetrate the second elements, hereby forming the grid structure, in such a way that an underside of the first elements facing the substrate and an underside of the second elements facing the substrate are located in a common plane. Unlike the method of prior art described at the outset, both the first elements and the second elements provide on their respective undersides a contact surface, via which the connection of the grid structure to the substrate can occur. A correspondingly large contact surface allows to achieve a reliable connection of the grid structure to the substrate, even with relatively simple means, such as in particular by means of an adhesive. A reliable connection is of great importance so that the clothing is prevented from prematurely failing, particularly separating, during the intended operation of the machine in which it is exposed to strong and changing loads.

As all surfaces naturally have a certain roughness and, moreover, the grid structure is subject to manufacturing tolerances, it is to be understood under the term "common plane" in the meaning of the present invention that the underside of the first elements and the underside of the second elements are to be in a tolerance range, which shall deviate from the ideal plane by not more than 10%, preferably by not more than 5%, of the thickness of the grid structure. This way it should be ensured that, if the grid structure is designed flat on a level floor, both the undersides of the first elements as well as the undersides of the second elements touch the floor, wherein it is not necessary to apply any or only a small, area-wide distributed pressure of max. 10 $N/m^2$.

The term "penetrating" is to be broadly understood in the sense of the present invention. Essentially, it is important that the grid structure comprises oblong elements that cross each other. Preferably, the oblong elements are connected to each other at the intersections in a material-to-material fashion, in particular merged with each other. However, the grid structure can also be generated differently, for example integrally in one piece using a casting process.

In a variant of the present invention, it is suggested that an adhesive layer is arranged between the substrate and the grid structure, which connects the substrate with the grid structure, wherein the adhesive layer preferably comprises a moisture-curing thermoplastic material. Good results were also yielded in experiments with a reactive melt adhesive based on polyurethane. Such an adhesive is commercially offered under the number 716.8 from the company Kleiberit, for example. In particular, the reactive melting adhesive offered by the company Finna Kleiberit under number 704.6 and based on polyurethane has shown very good results.

In order to ensure that the connection of the grid structure to the substrate can also be reliably achieved with simple means, such as with an adhesive, it is further suggested that the first elements and the second elements provide a contact area in the joint plane, which is defined by the underside of the first elements and the second elements, which contact area is at least 40%, preferably at least 50%, further preferably at least 60%, of the area of the planar overall dimension of the grid structure. The contact area is preferably in the common plane.

It has proven particularly advantageous if a surface of the first elements facing away from the substrate and a surface of the second elements facing away from the substrate are not located in a common plane. This way, on the side of the grid structure facing away from the substrate, on which the fibrous web to be generated or processed is transported when used as intended, a structured surface develops with the help of which structures can be transferred to the fibrous web, which is particularly important for tissue.

Preferably, the first elements and/or the second elements show everywhere along the direction of their longitudinal extension substantially the same cross-section orthogonal in reference thereto. For example, this cross-section can be substantially rectangular or round or oval or combinations of these forms. The grid structure can therefore be produced in a particularly easy fashion. For example, the first elements and the second elements can be extruded and then connected to each other in order to form the structure described above.

Preferably, however, the first elements and the second elements have different heights. Thus, a distance between the underside and a top of the first elements can differ by at least 20%, preferably at least 30%, from a distance between the underside and a top of the second elements. In particular, the difference can range from 20% to 40%.

In principle, the grid structure can be formed exclusively from the first elements and the second elements. If the first direction and the second direction form an angle of 90°, here a rectangular grid structure results. If this angle deviates from 90°, then a diamond-like grid structure results.

In a variant of the present invention, however, it can also be provided that the grid structure comprises at least a plurality of additional elements, which are all aligned in a further direction, which is different from the first direction and the second direction, wherein preferably also an underside of the additional elements facing the substrate is located in a common plane, which is defined by the underside of the first elements and the underside of the second elements. For example, if the grid structure is formed from first elements, second elements, and third elements, the grid structure can be configured in a honeycomb shape.

The substrate is preferably a web consisting of warp threads and weft threads, in particular a single-layered web. However, the substrate can alternatively or additionally comprise at least one layer or ply, which is formed from a perforated film, in particular a punched film or laser-drilled film, a non-woven thread material, a felt, a spiral sieve, or a combination thereof. The substrate can here be formed predominantly or completely from PEZ and/or PPS and/or PA and/or PCTA.

The grid structure can comprise a TPU material and preferably be made from it. TPU represents here thermoplastic elastomers on a urethane basis. Alternatively, or additionally, the grid structure can include, for example, TPE, PET, and/or PP and/or PA, and/or be formed from it. Preferably, the material from which the grid structure is made can be easily extruded to simplify the manufacture of the grid structure.

The present invention also relates to a machine for producing or refining a fibrous web, in particular a paper, cardboard, or tissue web, comprising a clothing according to any of the preceding claims, wherein the clothing is preferably used as a structured TAD sieve in the machine. TAD stands for through-air dryers and such filters are used especially in the manufacture of tissue, which is used for example for toilet paper, facial tissues, etc.

Alternatively, the inventive clothing can be used as a so-called molding sieve in an Atmos machine of the company Finna Voith. Currently, woven and structured forming sieves are used for this application. By using the inventive clothing, depending on the construction of the grid structure, it is possible to increase the contact surface of the molding sieve to the Yankee cylinder. Further, with suitable material selection, the grid structure may show considerably more elastic properties than the woven, structured forming sieves of prior art. In this way, the contact area in the press gap can be increased noticeably due to compression features and elasticity, so that better drainage can take place in the press gap passage. Thus, higher dry contents can be achieved, the machine speed can be increased, and the production capacity as well as cost effectiveness of the system can be increased.

The inventive clothing in a NTT machine of the company Finna Valmet can be used, especially as a structured NTT web of such a machine. The structure of the paper web is here essentially determined by the embodiment of the grid structure. If a defined permeability of the finished clothing is to be achieved in the final application, it can be adjusted in addition to the design of the grid structure and the selection of the substrate, or alternatively by means of the quantity and type of the adhesive.

Furthermore, the inventive step can be used in the forming area of a conventional paper machine as a so-called forming sieve. In the process, the inventive clothing offers a variety of advantages in reference to conventional forming sieves, which are only woven. Thus, the inventive clothing can be manufactured more economically, because the production is less complex, usually requires fewer work steps, and can be standardized in a better fashion. Conventional forming sieves usually have relatively complex woven patterns. In addition, with the inventive clothing, compared to conventional forming sieves, faster dewatering can be achieved with consistent paper properties, as well as improved runability due to a clean run, because fewer cavities are present for fiber adhesion and/or contamination.

Also, the use of the inventive clothing as so-called marking belts is conceivable in different industrial applications.

According to the present invention, a method for producing the previously described clothing is proposed, in which the substrate and the grid structure are produced separately and then glued together.

In the process, adhesive can first be applied to the grid structure, preferably on the underside of the first elements facing the substrate and a underside of the second elements of the grid structure facing the substrate, before the grid structure is laminated on the substrate.

To achieve a viscosity of the adhesive, which allows it to reliably wet the underside of the first elements and the underside of the second elements, while leaving the apertures in the grid structure clear, it is suggested that prior to the application on the grid structure the adhesive is heated to a temperature above 100° C., preferably to a temperature from 110° C. to 130° C. Particularly when using a reactive melt adhesive based on polyurethane as the adhesive as described above, good results could be achieved when heating to these temperatures.

Furthermore, it is suggested in order to achieve good results that between 40 g/m$^2$ and 80 g/m$^2$ of the adhesive is applied to the grid structure, preferably between 45 g/m$^2$ and 55 g/m$^2$. On the one hand, a reliable connection of the grid structure on the substrate can be achieved and, on the other hand, a flow of excess adhesive into the openings of the grid structure is prevented.

The adhesive can here first be applied to a roller, which together with a counter roller forms a nip, through which the grid structure is guided out for wetting with the adhesive.

Alternatively, the adhesive can also be sprayed onto the grid structure to moisten it. Good results with a melting adhesive based on polyurethane could also be achieved here, as they are commercially sold, for example, under the number 704.6 or 716.8 by the company Finna Kleiberit©. Even when spraying on this adhesive, a full-surface wetting of the underside of the first elements and the underside of the second elements could be achieved without the adhesive reducing or even clogging the openings available in the grid structure.

The wetted grid structure can then be laminated on the substrate, on which preferably no adhesive has previously been applied, for example, by guiding the grid structure wetted with the adhesive, together with the substrate, through a roller nip. In principle, the grid structure can essentially comprise the same width as the substrate, or the grid structure can be formed more narrowly. In the latter case, several separate webs of the grid structure can be arranged next to each other on the substrate, or a continuous web can be applied spirally to the substrate.

Figure 2:
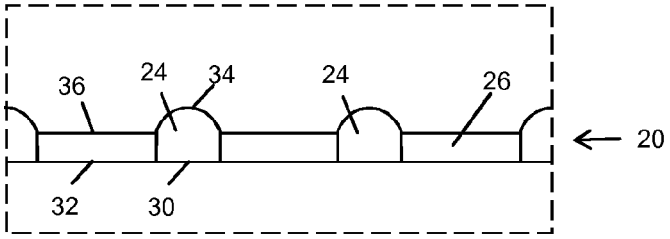
Figure 3:
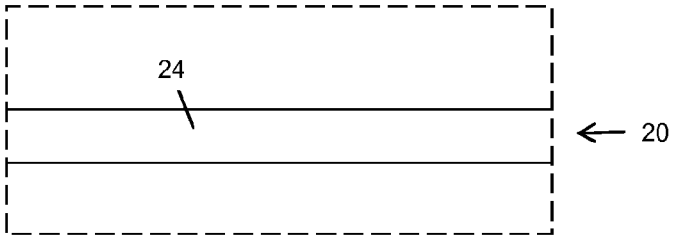
Figure 4:
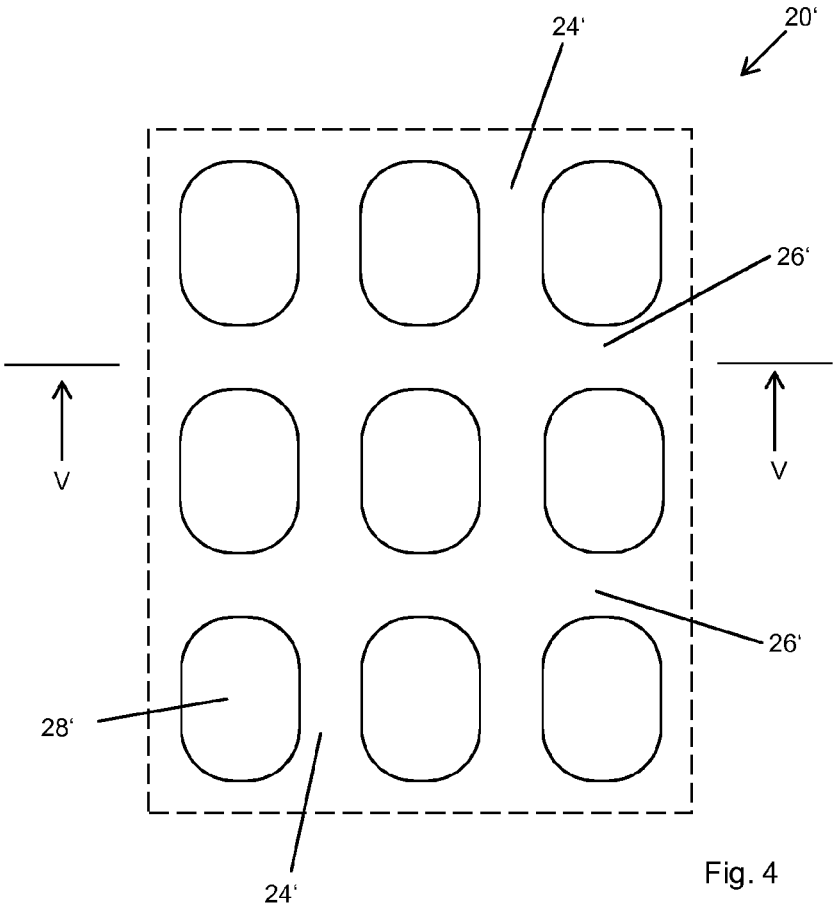
Figure 5:
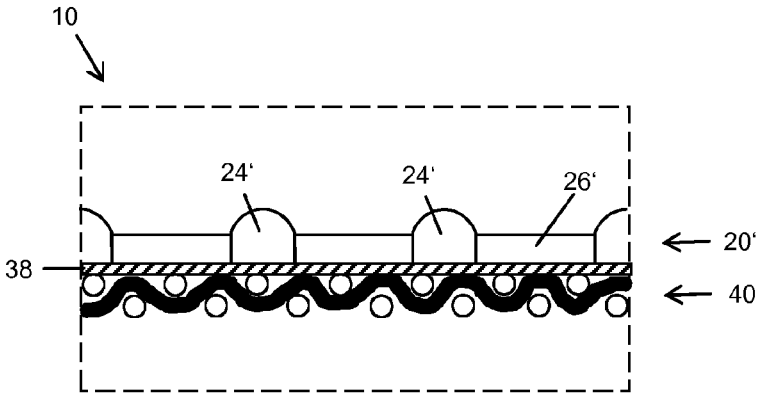

Based on exemplary embodiments, additional advantageous variants of the invention are explained with reference to the drawings. The features mentioned can be advantageously implemented not only in the combination shown, but also individually combined with each other. The non-scale figures show in detail:

FIG. 1 A detail of a grid structure according to a first exemplary embodiment, FIG. 2 A section through plane II-II in FIG. 1, FIG. 3 A section through plane in FIG. 1, FIG. 4 A detail of a grid structure according to a second exemplary embodiment, FIG. 5 A section through plane V-V in FIG. 4, supplemented by an adhesive layer and a substrate.

The figures are described in more detail below. FIG. 1 shows a small detail of a grid structure 20, which is surrounded by a dashed line. Here, the direction of sight in FIG. 1 is focused on the underside 22 of the grid structure, i.e. on the side which faces the substrate 40 in the finished clothing (see FIG. 5). The grid structure 20 consists of a plurality of first elements 24, all of which are aligned parallel to each other and extend in FIG. 1 in a vertical direction, and a plurality of second elements 26, which are likewise formed parallel to each other and extend in the horizontal direction in FIG. 2. The first elements 24 and the second elements 26 penetrate each other in order to form the grid structure 20. The first elements 24 and the second elements 26 can be made from an extruded plastic, such as TPU, and then merged with each other to form a grid. In the present exemplary embodiment, the distance between the first elements 24 is constant and corresponds to the distance between the second elements 26, which is also constant. Thus, a regular arrangement of substantially rectangular, particularly square, openings 28 in the grid structure 20 results. Due to the manufacturing process, with which the first elements 24 and the second elements 26 are merged with each other, the openings 28 are not necessarily embodied with sharp edges, but can have slightly rounded corners, as shown in the present exemplary embodiment. The area, which is formed by an underside 30 of the first elements 24 and an underside 32 of the second elements 26, is substantially planar and represents in FIG. 1 at least 60% of the total area, i.e. the area which is surrounded by the dashed frame in FIG. 1. Thus, a sufficiently large contact area for a reliable connection of the grid structure 20 to the substrate 40 is also provided with simple means, such as an adhesive.

FIG. 2 shows a section through plane II-II in FIG. 1. Here, it can be seen that the first element 24 shows a greater thickness, i.e. dimension in a vertical direction in FIG. 2, than the second element 26. In other words, the measurement of the underside 30 is greater than a top 34 of the first element 24 than the measurement of the underside 32 to a top 36 of the second element 26. Because the underside 30 of the first element 24 and the underside 32 of the second element 26 lie in the same plane, a profiling of the top part of the grid structure 20 is yielded, which in the intended use of the clothing 10 (see FIG. 5) faces the fibrous web to be manufactured or to be refined. This profiling is advantageous to the fibrous web, which thus shows only the pattern of openings 28, but also the pattern of parallel grooves, that are yielded by the various heights of the first elements 24 and second elements 26. As can be seen in FIG. 2, the first 5 elements 24 can have a cross-section orthogonal to its longitudinal direction of extension, which is rounded at the top, so that the top 24 of the first element 24 is formed only by a line which runs in the longitudinal direction of extension of the first element 24. The second element 26 can be configured this way, as well, although with lower height. Preferably, both the first elements 24 as well as the second elements 26 show a substantially equal cross-section everywhere along orthogonal in reference to the entire length of the longitudinal extension, wherein the material on the intersection points of the first elements 24 and the second elements 26 can run as already described before, which can lead to rounded corners of the openings 28.

FIG. 3 shows a section through plane III-III in FIG. 1. For reasons of simplicity, only the first element 24 is shown in this figure and not the second elements 26, which are completely merged in this sectional view with the first element 24.

FIG. 4 shows a view identical to FIG. 1, but illustrating a second embodiment of a grid structure 20'. Identical features of the second embodiment are equipped with identical reference signs as shown in the first embodiment, but showing an apostrophe. In this respect, reference is made to the above description.

The second embodiment differs from the first embodiment only in that the distance between the second elements 26' is greater than the distance between the first elements 24'. Thus, there are no substantially square, but rather essentially rectangular, openings 28' with an oblong shape.

FIG. 5 shows a section through plane V-V in FIG. 4. This sectional view corresponds in the essential sectional view in FIG. 2 to the first embodiment. However, in FIG. 5, in addition to the grid structure 20', the substrate 40 is also shown, which consists in this exemplary embodiment of a single-layer fabric with wharf and weft threads and an adhesive layer 38 arranged between the grid structure 20' and the substrate 40. Thus FIG. 5 shows a section of the finished clothing 10 which is limited by a dashed frame.

The clothing 10 is produced by first generating the grid structure 20' and the substrate 40 separately. Then, the grid structure 20' is equipped with the adhesive layer 38 and then laminated onto the substrate.

Both in the first embodiment according to FIGS. 1-3, as well as in the second embodiment according to FIGS. 4 and 5, the first element 24, 24' extends preferably in the machine direction, when the clothing 10 is used as intended, and the second elements 26, 26' extend in the machine transverse direction. Alternatively, however, the first elements 24, 24' can extend in the machine transverse direction and the second elements 26, 26' in the machine direction.

LIST OF REFERENCE CHARACTERS

10 Clothing
20, 20' Grid structure
22 Underside of the grid structure
24, 24' first elements
26, 26' second elements
28, 28' Openings
30 Underside of the first elements
32 Underside of the second elements
34 Top of the first element
36 Top of the second element
38 Adhesive layer
40 Substrate

The invention claimed is:

1. Structured fabric (10) for a machine for producing or refining a fibrous web, comprising a substrate (40) and a grid structure (20, 20') applied on the substrate (40), on which the fibrous web is transported, wherein the grid structure (20, 20') comprises a plurality of first elements (24, 24'), all of which are aligned in a first direction, and a plurality of second elements (26, 26'), all of which are aligned in a second direction which differs from the first direction, wherein the first elements (24, 24') penetrate the second elements (26, 26'), forming a grid structure (20, 20'), wherein an underside (30) facing the substrate (40) of the first elements (24, 24') and an underside (32) of the second elements (26, 26') facing the substrate (40) are in a common plane, wherein the plurality of first elements extend continuously across the structured fabric in the first direction and the plurality of second elements extend continuously across the structured fabric in the second direction, and wherein the entire top side, facing away from the substrate, of each first element is not in a common plane with the entire top side, facing away from the substrate, of each second element so as to form a pattern of parallel grooves across the structured fabric.

2. Structured fabric (10) according to claim 1, wherein a bonding layer (38) is arranged between the substrate (40) and the grid structure (20, 20'), which connects the substrate (40) with the grid structure (20, 20'), with the adhesive layer (38) comprising a moisture-curing thermoplastic material or a reactive melt adhesive based on polyurethane or it is formed from this.

3. Structured fabric (10) according to claim 1, wherein the first elements (24, 24') and the second elements (26, 26') are provided in the common plane, which is defined by the underside (30) of the first elements (24, 24') and the underside (32) of the second elements (26, 26'), forming a contact area, which comprises at least 40% of the planar total dimensions of the grid structure (20, 20').

4. Structured fabric (10) according to claim 1, wherein a top (34) of the first elements (24, 24') facing away from the substrate (40) and a top (36) of the second elements (26, 26') facing away from the substrate are not in a common plane.

5. Structured fabric (10) according to claim 1, wherein a distance between the underside (30) and a top side (34) of the first elements (24, 24') differs by at least 20% from a distance between the underside (32) and a top side (36) of the second elements (26, 26').

6. Structured fabric (10) according to claim 1, wherein the grid structure (20, 20') furthermore comprises at least a plurality of additional elements, all of which are aligned in a further direction, which is oriented differently in reference to the first direction and the second direction, wherein an underside of the further elements facing the substrate (40) is located in the common plane, which is defined by the underside (30) of the first elements (24, 24') and the underside (32) of the second elements (26, 26').

7. Structured fabric (10) according to claim 1, wherein the substrate (40) is a web comprising warp threads and weft threads, and the web is a single-ply web.

8. Structured fabric (10) according to claim 1, wherein the grid structure comprises (20, 20') TPU material.

9. Machine for producing or refining a fibrous web, comprising a structured fabric (10) according to claim 1, wherein the structured fabric (10) is used as a structured TAD sieve in the machine.

10. Method for producing a structured fabric (10) according to claim 1, wherein the substrate (40) and the grid structure (20, 20') are manufactured separately and then glued together.

11. Method according to claim 10, wherein initially adhesive is applied on the grid structure (20, 20'), on the underside (30) of the first elements (24, 24') facing the substrate (40), and the underside (32) of the second elements (26, 26') facing the substrate (40) of the grid structure (20, 20'), before the grid structure (20, 20') is laminated to the substrate (40).

12. Method according to claim 11, wherein the adhesive is heated to a temperature above 100° C. before applying it to the grid structure (20, 20'.

13. Method according to claim 11, wherein between 40 $g/m^2$ and 80 $g/m^2$ of the adhesive is applied to the grid structure (20, 20').

14. Method according to claim 11, wherein the adhesive is first applied to a roller, which together with a counter roller forms a nip, through which the grid structure (20, 20') is guided for wetting with the adhesive.

15. Method according to claim 11, wherein the adhesive is sprayed to the grid structure (20, 20') for wetting.

* * * * *